US011518134B2

(12) United States Patent
Jensen et al.

(10) Patent No.: US 11,518,134 B2
(45) Date of Patent: Dec. 6, 2022

(54) METHOD AND APPARATUS FOR MAKING DRAW STRIP BAGS

(71) Applicant: Roll-O-Matic A/S, Vissenbjerg (DK)

(72) Inventors: John Buk Jensen, Munkebo (DK); Mads Sandahl Christensen, Tommerup (DK); Jens Peder Rasmussen, Odense SO (DK)

(73) Assignee: ROLL-O-MATIC A/S, Vissenbjerg (DK)

( * ) Notice: Subject to any disclaimer, the term of this patent is extended or adjusted under 35 U.S.C. 154(b) by 407 days.

(21) Appl. No.: 16/064,895

(22) PCT Filed: Dec. 15, 2016

(86) PCT No.: PCT/EP2016/081156

§ 371 (c)(1),
(2) Date: Jun. 21, 2018

(87) PCT Pub. No.: WO2017/108567

PCT Pub. Date: Jun. 29, 2017

(65) Prior Publication Data

US 2019/0001605 A1 Jan. 3, 2019

(30) Foreign Application Priority Data

Dec. 22, 2015 (DK) ..... PA 2015 70862
Jan. 4, 2016 (DK) ..... PA 2016 70003

(51) Int. Cl.
*B31B 70/81* (2017.01)
*B65D 33/28* (2006.01)
(Continued)

(52) U.S. Cl.
CPC ..... *B31B 70/8135* (2017.08); *B65D 33/28* (2013.01); *B31B 70/942* (2017.08);
(Continued)

(58) Field of Classification Search
CPC ..... B31B 70/8135; B31B 2155/00; B31B 2170/10; B31B 70/942; B31B 2160/10;
(Continued)

(56) References Cited

U.S. PATENT DOCUMENTS 2,777,491 A * 1/1957 Ashton ..... B65D 33/28 383/75
2,897,729 A * 8/1959 Ashton ..... B31B 70/00 493/196

(Continued)

FOREIGN PATENT DOCUMENTS

DE 4244024 9/1994
EP 1232954 8/2002

(Continued)

OTHER PUBLICATIONS

Search Report Danish Application No. PA 2015 70862, completed Aug. 11, 2016.

(Continued)

*Primary Examiner* — Sameh Tawfik
(74) *Attorney, Agent, or Firm* — Crowell & Moring LLP; John C. Freeman

(57) ABSTRACT

Continuous method for making a web of draw strip bags, comprising providing a film web (F) wherein a first portion (11) and a second portion (12) overlap each other with free longitudinal side edges (7, 7') thereof being essentially aligned with each other, back folding a first part (13) having said free side edge (7) of the first portion (11) outwardly away from said second portion (12) along a first fold line (B) by a first hemmer (120), and by folding a first subpart (15) of said first part (13) along a second fold line (C) whereby the free side edge (7) of the first portion (11) is brought into near alignment with said first fold line (B) while a second subpart (14) of said first part (13) of the first portion (11)
(Continued)

Figure 1A:
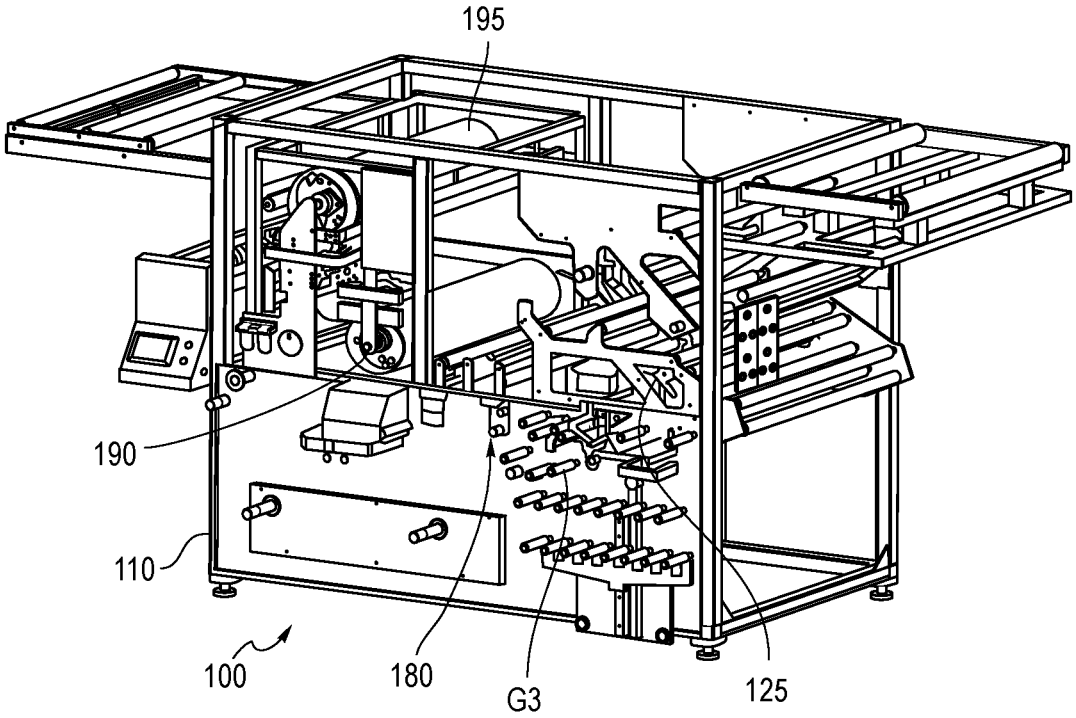

remains back folded, whereby said first and second subparts (14, 15) of the first portion define a first hem (H1).

14 Claims, 5 Drawing Sheets

(51) Int. Cl.
*B31B 170/10* (2017.01)
*B31B 160/10* (2017.01)
*B31B 155/00* (2017.01)
*B31B 70/94* (2017.01)

(52) U.S. Cl.
CPC ..... *B31B 2155/00* (2017.08); *B31B 2160/10* (2017.08); *B31B 2170/10* (2017.08)

(58) Field of Classification Search
CPC ..... B31B 70/8123; B31B 70/8133; B31B 70/8134; B65D 33/28
USPC ..... 493/243
See application file for complete search history.

(56) References Cited

U.S. PATENT DOCUMENTS

| | | | | | |
|---|---|---|---|---|---|
| 3,010,640 | A * | 11/1961 | Kugler | B65D 33/28 | 383/75 |
| 3,058,402 | A | 10/1962 | Emanuel | | |
| 3,058,403 | A | 10/1962 | Emanuel | | |
| 3,196,757 | A * | 7/1965 | Samways | B65D 33/28 | 493/194 |
| 3,279,331 | A * | 10/1966 | Platt | B65D 33/20 | 493/189 |
| 3,568,576 | A | 3/1971 | Lehmacher et al. | | |
| 3,942,713 | A * | 3/1976 | Olson | B65D 33/20 | 383/62 |
| 4,430,845 | A | 2/1984 | Dohrendorf | | |
| 4,558,463 | A | 12/1985 | Boyd | | |
| 4,581,007 | A * | 4/1986 | Kamp | B65D 33/20 | 493/223 |
| 4,597,750 | A | 7/1986 | Boyd et al. | | |
| 4,617,008 | A * | 10/1986 | Boyd | B65H 45/08 | 493/243 |
| 4,624,654 | A | 11/1986 | Boyd et al. | | |
| 4,714,455 | A | 12/1987 | Herrington | | |
| 4,832,507 | A | 5/1989 | Herrington | | |
| 5,057,065 | A | 10/1991 | Buchman | | |
| 5,797,828 | A * | 8/1998 | Selle | B31B 70/00 | 493/191 |
| 6,602,174 | B1 * | 8/2003 | Haverfield | B29C 65/10 | 493/191 |
| 7,520,673 | B2 * | 4/2009 | Bonke | B65F 1/0006 | 220/495.11 |
| 7,914,207 | B1 | 3/2011 | Beam | | |
| 10,131,468 | B2 * | 11/2018 | Ishihara | B65B 43/30 | |
| 2007/0274614 | A1 * | 11/2007 | Abel | B29C 66/723 | 383/126 |
| 2010/0303388 | A1 | 12/2010 | Kent et al. | | |

FOREIGN PATENT DOCUMENTS

| | | | |
|---|---|---|---|
| FR | 1376061 | | 10/1964 |
| FR | 2291025 | A1 | 6/1976 |
| JP | 2002036391 | A | 2/2002 |

OTHER PUBLICATIONS

Preliminary Report on Patnatbility for PCT/EP2016/081156, dated Jun. 26, 2018.
International Search Report and Written Opinion for PCT/EP2016/081156, dated Apr. 10, 2017.

* cited by examiner

METHOD AND APPARATUS FOR MAKING DRAW STRIP BAGS

RELATED APPLICATIONS

This application claims the benefit under 35 U.S.C. § 371 of the filing date of International Patent Application No. PCT/EP2016/081156, having an international filing date of Dec. 15, 2016, which claims priority to Danish Application No. PA201570862, filed Dec. 22, 2015, and Danish Application No. PA201670003, filed Jan. 4, 2016, the contents of all of which are incorporated herein by reference in their entirety.

The present application relates to draw strip bags, in particular to a method and apparatus for making draw strip bags.

BACKGROUND OF THE INVENTION

Draw strip bags have been known for several years and are described in various references such as U.S. Pat. Nos. 4,624,654, 5,057,065, 4,832,507 and 4,558,463, FR patents no. 2,291,025 and 1,376,061 and DE patent application 4,244,024. Bags of this type have an opening or mouth at an edge, along which opening a tubular hem on each side of the bag is provided which contains a pliable thermoplastic strip or band. One or more holes in the hems expose the draw strip or strips, allowing it or them to be pulled through the opening and possibly used as a handle while simultaneously closing the open mouth of the bag.

One conventionally employed method of forming the hems and introducing the strip is described in U.S. Pat. No. 4,624,654. A flat web of a thermoplastic film or foil with respective longitudinal side edges moves past a continuous draw strip string insertion station. The web of thermoplastic film has initially been folded lengthwise so as to have two opposed portions, which portions lie flatly against each other. By an inward folding along the two longitudinal side edges respective hems are formed, into each of which a continuous draw strip string defining the draw strips is introduced at the insertion station while being unwound from a reel. The continuous web of lengthwise folded film with hems and continuous draw strip strings is thereafter transversely heat sealed and provided with cross-wise perforations to form a web of bags, which web of bags is then rolled up and later severed along the perforations, such as by the end-user, for individualising the draw strip bags.

Figure 3:
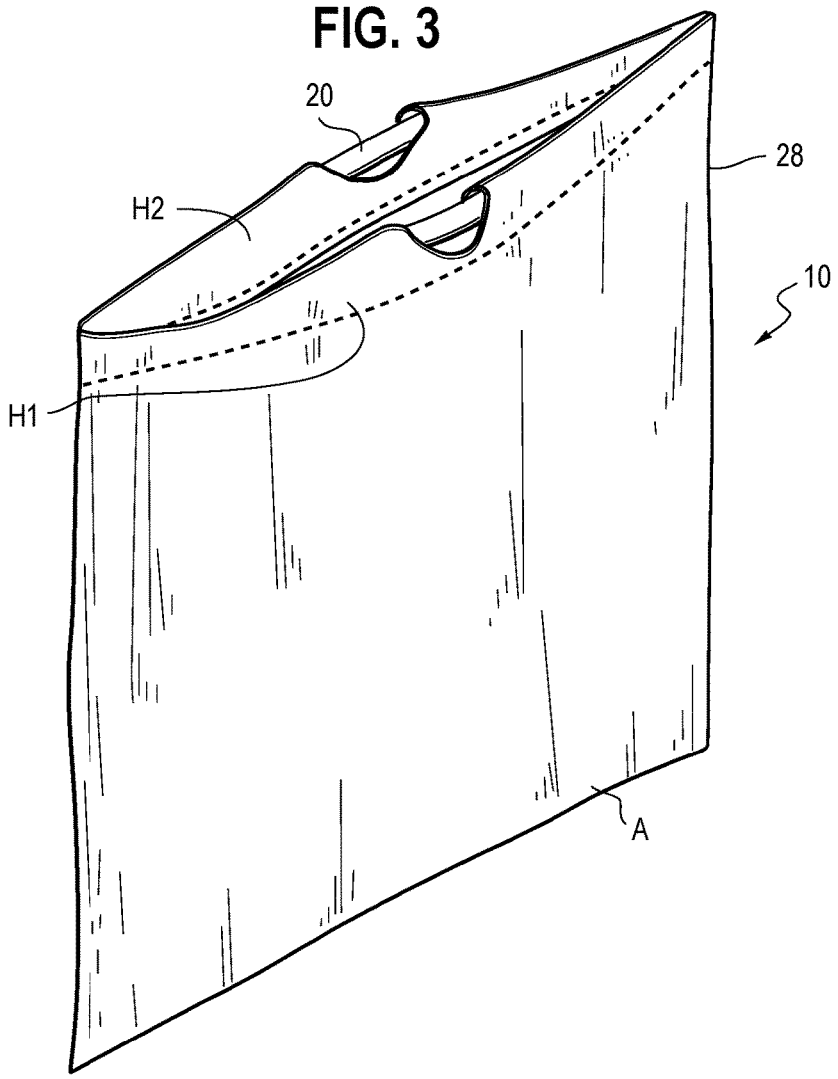

A distinct characteristic of this conventional method of manufacturing and the apparatus employed to practice it is that the opposed portions of the lengthwise folded film are parted completely such that they no longer contact each other, after which the inward folding along the two longitudinal side edges is carried out simultaneously, as shown in FIG. 3 of U.S. Pat. No. 4,624,654, to form the hems. This complete separation of the opposed portions from each other is required to provide space for the inward folding and the blades or plows, often also referred to as the "hemmers", used for bringing about the inward folding. A disadvantage of this complete separation is that air invariably becomes trapped as the two opposed portions are brought against each other again, as shown in FIG. 9 of that document, for carrying out the subsequent transverse heat sealing. The result is that the web of bags contains entrapped air between the aforementioned opposed portions of the film and cannot be wound up tightly.

It is noted that bags with outwardly folded side edges are also known, see by way of example U.S. Pat. No. 4,832,507.

For many applications such bags may however not be desirable, such as where the thermoplastic film is a layered structure including a layer of a recycled thermoplastic material wherein one face of the film has a less aesthetically attractive appearance. This material then becomes visible from the outside of the bag on making the outward folding.

OBJECT OF THE INVENTION

It is one object of the invention to provide a method and apparatus for making a web of draw strip bags that may be wound up tighter in the form of rolls. In particular, it is an object of the invention to reduce or eliminate air entrapped in rolls of draw strip bags. It is yet a further object of the invention to provide an apparatus suitable for selectively making draw strip bags with side edges folded inwards as well as with side edges folded outwards.

SUMMARY OF THE INVENTION

The continuous method of the present invention solves the above problem by a sequence of process steps, comprising the following steps:

- providing a film web wherein a first portion and a second portion overlap each other with free longitudinal side edges thereof being aligned or essentially aligned with each other,
- back folding a first part having said free side edge of the first portion outwardly away from said second portion along a first fold line by a first hemmer, with the rest of the first portion preferably remaining in full contact with said second portion, and
- folding a first subpart of said first part along a second fold line whereby the free side edge of the first portion is brought into near alignment, or alignment, with said first fold line while a second subpart of said first part of the first portion remains back folded, whereby said first and second subparts of the first portion define a first hem.

At this time during the process the first hem appears inverted.

A next process step involves folding, preferably simultaneously with the back-folding of said first part of the first portion, a first part of the second portion having said free side edge thereof, to create a third fold line, with a first subpart overlying a second subpart and having the same width, or about the same width, such that the free edge of said second portion is aligned with, or near aligned with, said first fold line of the first portion whereby said first and second subparts of the second portion define a second hem.

The first hem is now turned by folding the first hem about the first fold line such that the second fold line is aligned with, or essentially aligned with, the third fold line of the second portion.

DETAILED DESCRIPTION OF EMBODIMENTS OF THE INVENTION

Figure 1B:
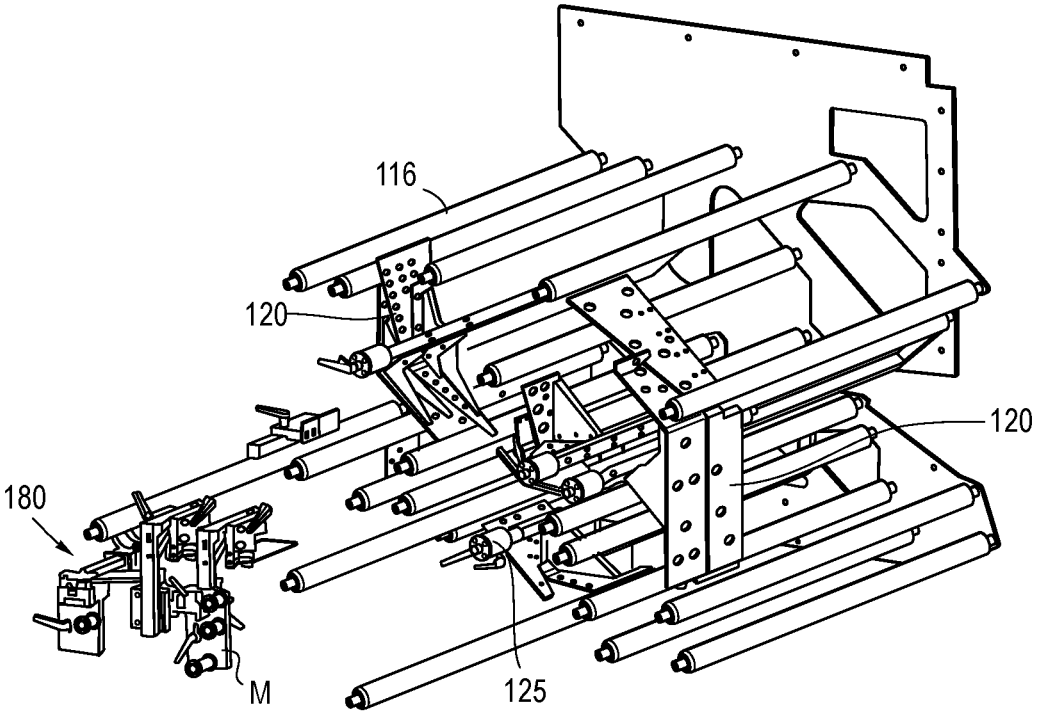
Figure 1C:
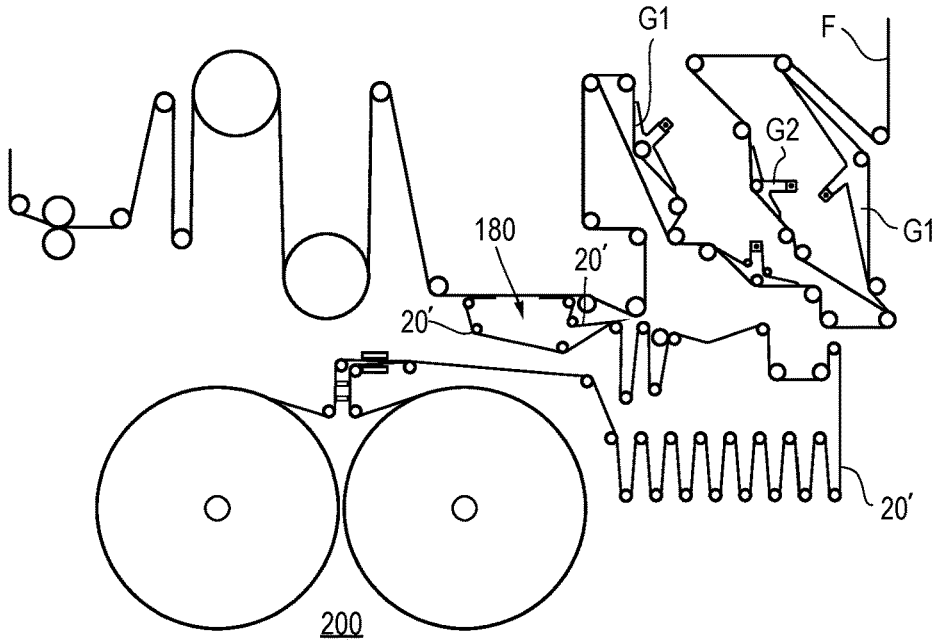
Figure 2:
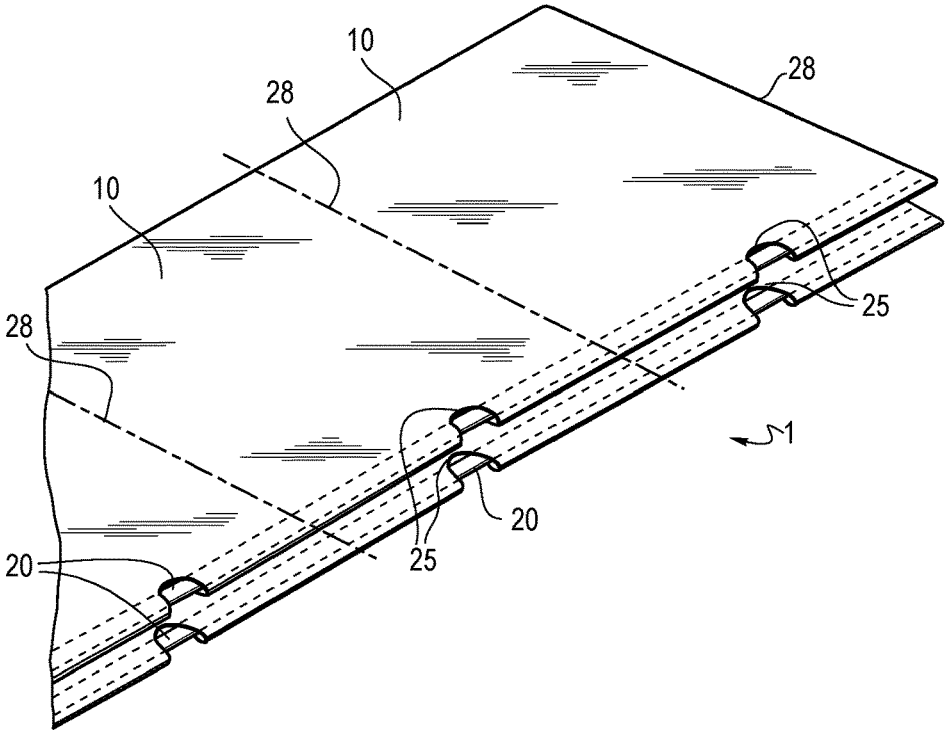
Figure 4A:
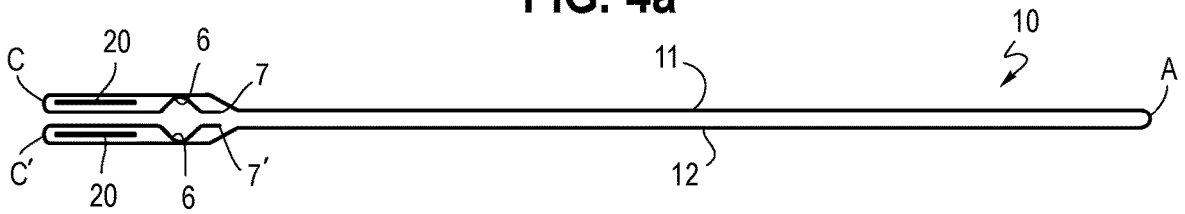
Figure 4B:
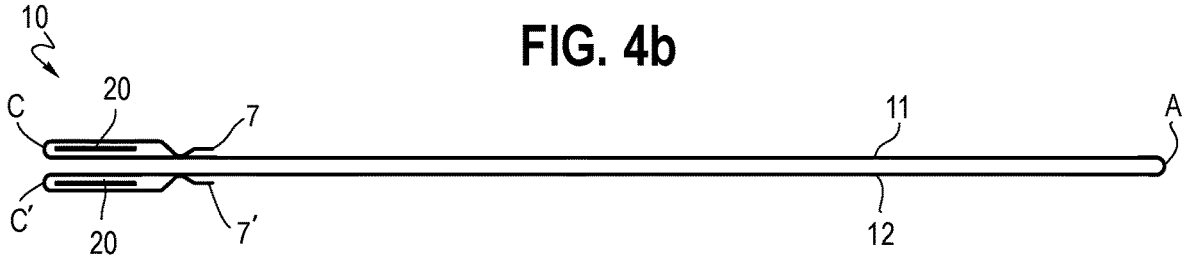
Figure 5A:
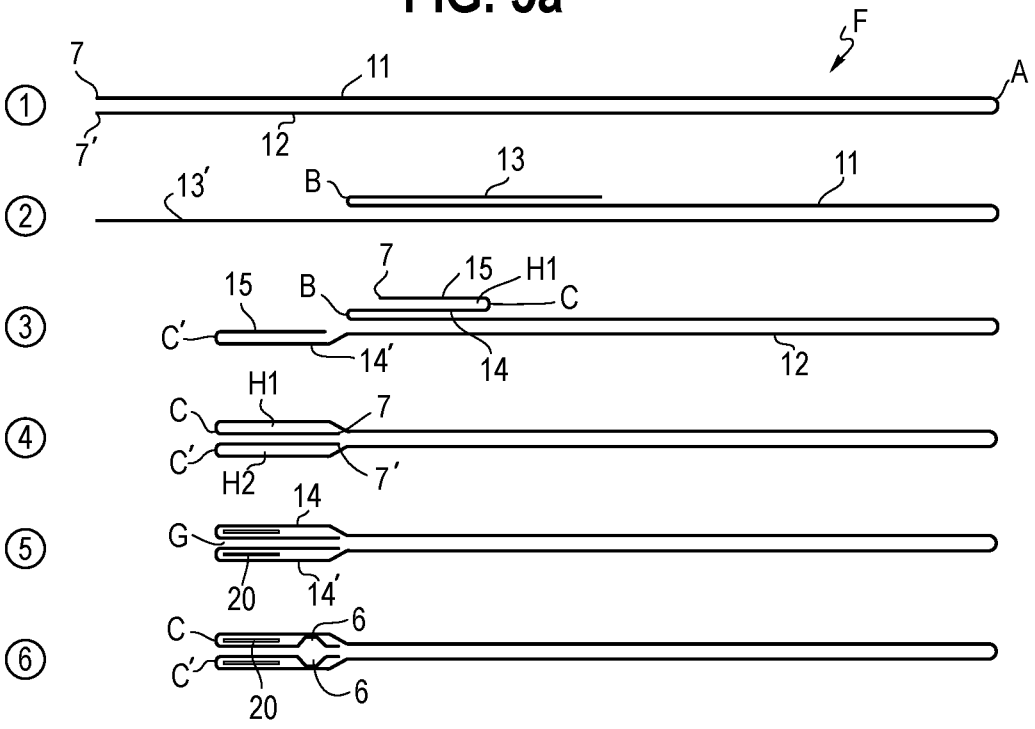
Figure 5B:
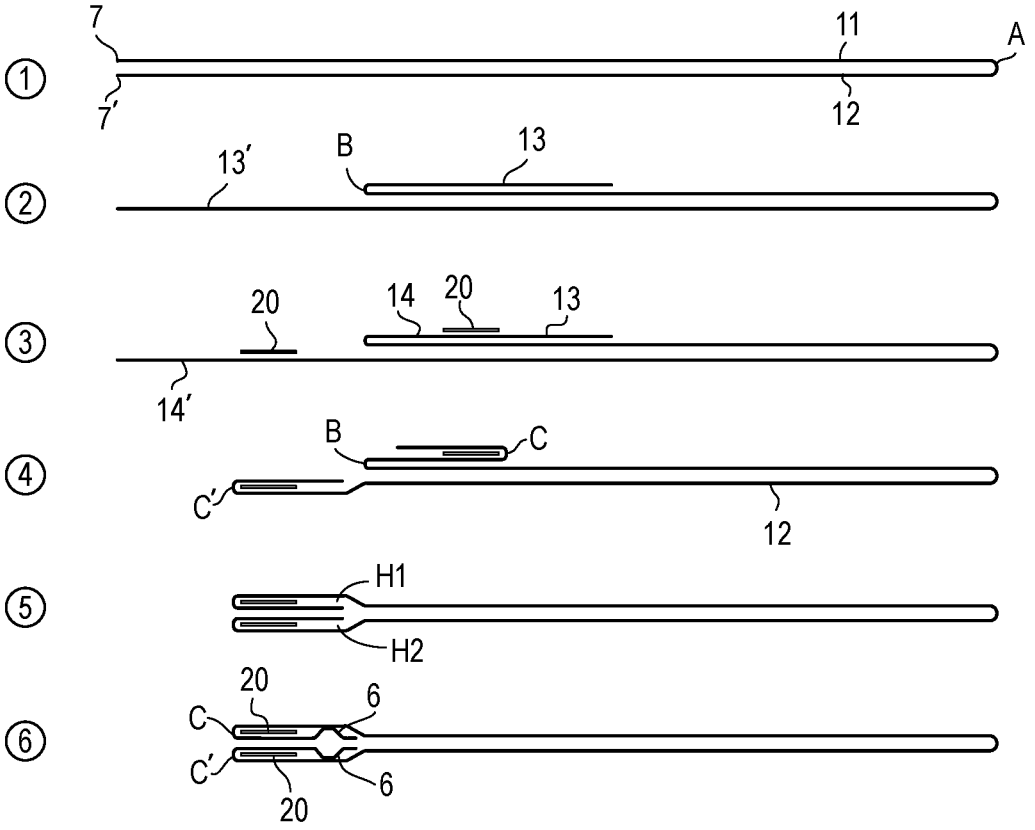
Figure 5C:
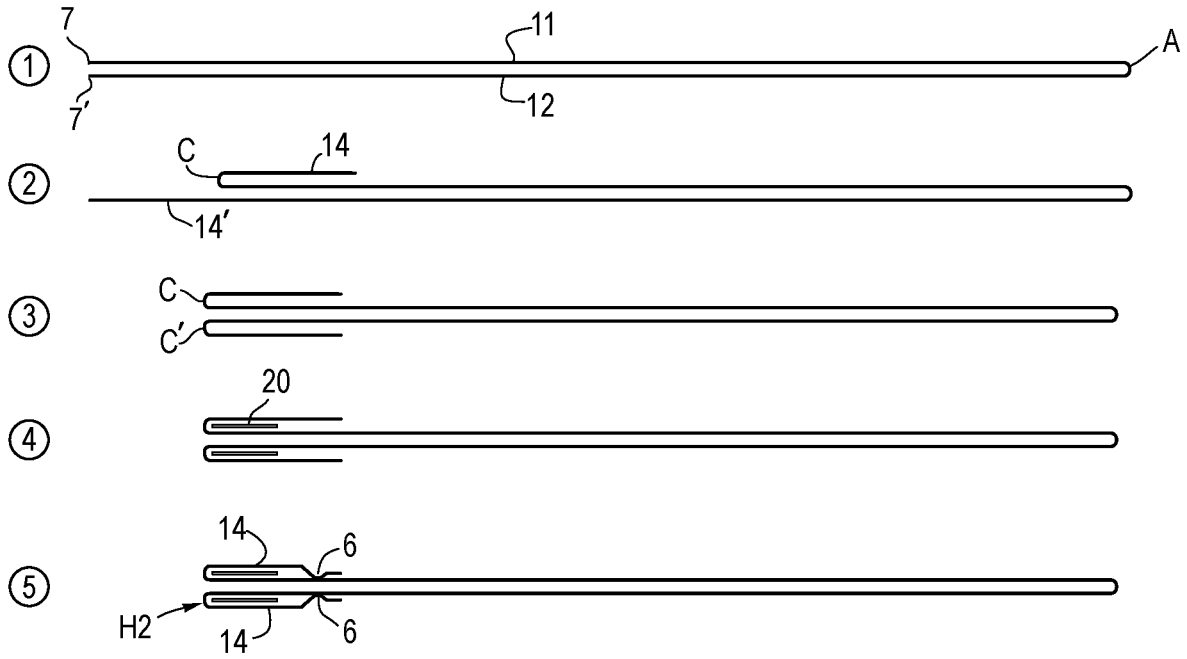
Figure 6:
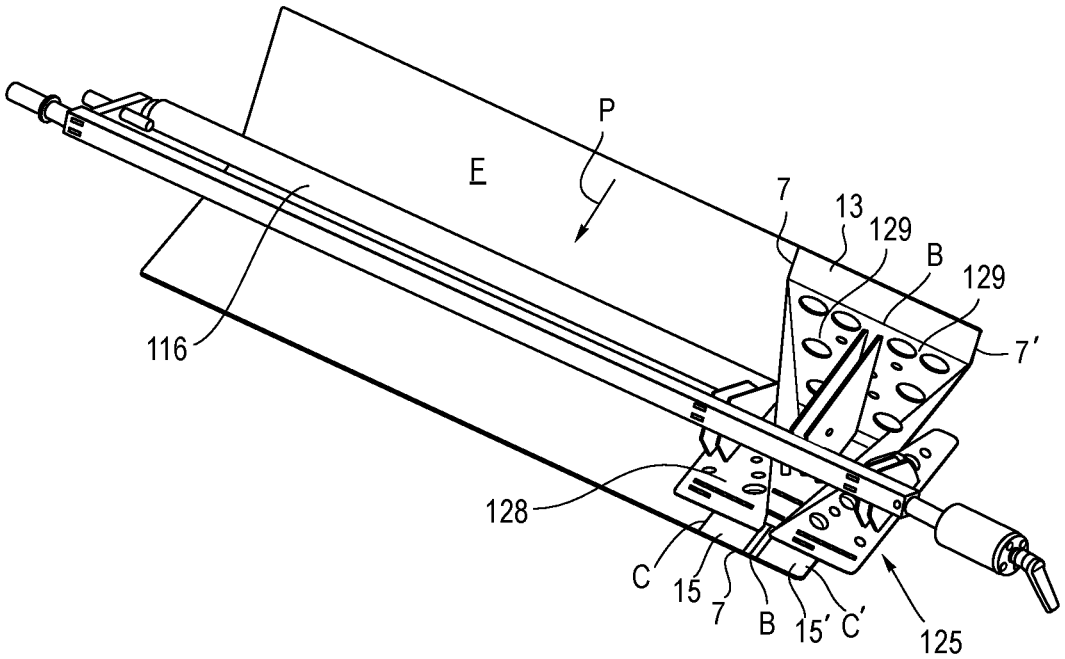

FIG. 1*a* shows an apparatus according to the invention,

FIG. 1*b* shows an enlarged portion of the apparatus of FIG. 1*a*, seen from the same view, FIG. 1*c* shows schematically two different configurations of the apparatus of FIG. 1*a*, for making one or the other of the bags of FIGS. 4*a* and 4*b*, FIG. 2 shows schematically a web of draw strip bags, FIG. 3 shows schematically one draw strip bag separated from the web of FIG. 2, FIGS. 4*a* and 4*b* are schematic cross-sectional views, showing a draw strip bag with inwardly and outwardly folded longitudinal side edges, respectively, FIGS. 5*a* and 5*b* are cross-sectional views illustrating the progress of the novel folding according to the invention, for making the draw strip bag of FIG. 4*a*, with the draw strip string positioned according to two different principles during the manufacturing, FIG. 5*c* similarly illustrate a folding principle for making the draw strip bag of FIG. 4*b* with outwardly folded side edges, and FIG. 6 shows schematically a hemmer used in the apparatus of FIG. 1*a*, for step 3 in the folding shown in FIG. 5*a*.

FIG. 1*a* shows, seen from a side, an embodiment of an apparatus 100 of the present invention suitable for making a continuous web 1 of draw strip bags 10 as shown generally in FIG. 2, which web 1 is subsequently wound up into rolls (not shown), from which an end user may individualise draw strip bags 10 as shown in FIG. 3. The web 1 has transverse seals and perforations 28 to define the individual bags 10. Cut-outs 25 are formed prior to insertion of draw strip strings, to allow a user to grip the individual draw strips 20.

The draw strip bags 10 are, depending on the configuration of the apparatus 100, formed with a cross-section as shown in FIG. 4*a* with inwardly folded longitudinal side edges 7, 7' forming hems, or—as shown in FIG. 4*b*—with outwardly folded longitudinal side edges 7, 7' forming hems, wherein the folding is done by hemmers as a web of film or foil is advanced through the apparatus 100.

The apparatus 100 generally comprises a frame 110 supporting rollers 116, some rollers 116 of which carry the hemmers 120, as well as a draw strip string 20' insertion station 180. Further stations 190, 195 (not discussed in further details) for transverse sealing and perforation are located downstream (to the left in FIG. 1*a*) the insertion station 180 while a station for making the cut-outs 25 is located immediately upstream the insertion station 180.

A lengthwise folded or doubled elongated web F of plastics material film or foil (not shown in FIG. 1*a*) with two aligned, or essentially aligned, free longitudinal side edges 7, 7' is drawn into the apparatus 100 from the right hand side thereof, from a storage roll or alternatively directly from an extruder. In one alternative form the web F may have been manufactured as a tube which has been collapsed and cut up lengthwise, thereby forming the two aforementioned longitudinal side edges with an opposite lengthwise fold. Alternatively, the draw strip bags 10 may be formed using the apparatus 100 on the basis of two superposed individual webs of plastic material films of same, or essentially same, width, joined—such as by welding—along one pair of aligned free side edges; such joining is preferably carried out before the webs enter the apparatus 100 but may even be carried out after that step.

Generally, the film web F being processed by the apparatus 100 is such that the free aligned or essentially aligned longitudinal side edges 7, 7' are flush/aligned with each other, with two identical opposed portions 11, 12 of the film fully overlapping each other and typically clinging to each other due to static electricity. Such a film web F fed into the apparatus 100 is illustrated is cross-section in the top of FIG. 5*a*.

The hemmers 120, or at least some of them, are preferably divided into two groups, as explained below, wherein one group G1 is for folding the film web F into draw strip bags 10 in the novel way shown in FIGS. 5*a* and 5*b* while the other group G2 is for folding the film into bags as shown in FIG. 4*b*, according to the conventional scheme illustrated in FIG. 5*c*. A user may configure the apparatus 100 or pathway of the film web F such that it passes through one or the other group G1, G2 of hemmers 120. At the same time, appropriately selected draw strip string insertion station 180 inserters for inserting a draw strip string 20' into the respective hems H1, H2 are mounted in correct operative position at station 180, according to the type of draw strip bags 10 to be made. An example of inserters for draw strip bags 10 as shown in FIG. 4*a*, i.e. of the type having inwardly folded side edges, is disclosed in FR patent 2,291,025. Examples of hemmers 120 for inward folding of side edges are disclosed in U.S. Pat. Nos. 4,617,008, 5,797,828, 4,714,455 and 4,430,845.

FIG. 1*b* is an enlarged view of the apparatus of FIG. 1*a*; FIG. 1*c* shows the pathway (illustrated in unbroken line) followed by the film web F through the group G1 of hemmers 120. Group G1 includes in a preferred embodiment a hemmer 125 as shown in FIG. 6 wherein a simultaneous folding is performed along both side edges 7, 7' of the film web F, as discussed below. The hemmer 125 includes plows 128 engaging the film web F along the parallel side edges 7, 7' to bring about the folding, and fixtures 129 that maintain a previously formed fold as the film web F moves through the hemmer 125 along direction P. Another pathway, illustrated in broken line, extends through group G2; the aforementioned two pathways combine before reaching the cut-out station and/or insertion station 180.

Turning now to the draw strip bag 10 with inwardly folded and aligned side edges 7, 7' as shown in FIG. 4*a*, a manufacturing method thereof according to the present invention will now be discussed with reference to FIGS. 5*a* and 5*b*. FIGS. 5*a* and 5*b* each illustrate a sequence of seven different process steps carried out by the apparatus of FIG. 1*a*. In a first process step 1), a folded film web F is introduced into the apparatus 100 in the shown configuration wherein a first portion 11 and an identical second portion 12 of the film web F overlap each other fully, with a longitudinal primary fold line A defining the transition from one portion 11 to the other 12, reference numerals 7 and 7' designating the respective two free longitudinal side edges of the film F. The primary fold line A defines the bottom of the bag 10. Where the two portions 11, 12 are welded together, or are welded together further downstream, letter A represents a welding line.

In the next process step 2) of FIG. 5*a* a first part 13 (typically of width 10-14 cm) of the first portion 11, which first part 13 has the free side edge 7, is back folded outwardly away from the second portion 12 along secondary fold line B (referred to in the appended claims as "first fold line B") by a first hemmer 120, so as to face the rest of the first portion 11. The hemmer 120 is such that the rest of the first portion 11 preferably remains in full contact with the second portion 12, by engaging only the first part 13.

In a third process step 3) as the web F moves onwards along its pathway a further hemmer, such as hemmer 125 described above in connection with FIG. 6, engages a section of the aforementioned first part 13 from below such as to fold a first subpart 15 thereof forward along tertiary fold line C (referred to in the appended claims as "second fold line C") whereby the free side edge 7 of the first portion 11 is brought into near alignment, such as at the illustrated distance which may be of 1 cm-2 cm or less, or alignment, with the aforementioned secondary fold line B while another, second subpart 14 of the first part 13, i.e. the rest of the first part 13, remains back folded. The now overlying first and second subparts 14, 15 are intended to define a hem part H1 of the final bag 10. As seen, in the process step the hem H1 appears inverted.

Simultaneously with the folding of the first part 13 of the first portion 11 (or with a slight delay using a another, downstream hemmer 120) there is a folding in process step 3) of a first part 13' of the second portion 12, which first part 13' has the free side edge 7' of the second portion 12. This folding creates another secondary fold line C' (in the claims referred to as third fold line C') in that a first subpart 15', which has the free side edge 7' of the second portion 12, is brought to overlie or face a second subpart 14' of the first part 13' of the second portion 12. Preferably, as shown, the folding is inwards (or upwards, as shown in FIG. 5*a*) whereby the first subpart 15' of the first part 13' of the second portion 12 is closer to the first portion 11 than the second subpart 14' of the first part 13' second portion 12. The first and second subparts 14', 15' of the first part 13' of the second portion 12 have the same width, or essentially the same width, such that the free edge 7' of the second portion 12 becomes aligned with, or near aligned, with secondary fold line B of the first portion 11. The first and second subparts 14', 15' of the second portion 12 of the film web F are intended to define a further hem part H2 of the final bag 10.

Alternatively, although not presently preferred, the creation of the secondary fold line C' may be outwards (or downwards in FIG. 5*a*) folding of the first part 13' relative to the inside of the finished bag 10 whereby the first subpart 15' is farther away from the first portion 11 than the second subpart 14', as shown for hem H2 in FIG. 5*c* whereby the same inserter for inserting the draw strip string 20' into hem H2 may be used when running all the processes shown in FIGS. 5*a*, 5*b* and 5*c*.

In a subsequent process step 4) the hem part H1 is now folded forwards about secondary fold line B such that the tertiary fold line C of the first portion 11 of the film web F becomes aligned with the secondary fold line C' of the second portion 12. By adjusting the width of the various subparts 14, 15, 14', 15' the two hems H1, H2 can be made equal in size such that the final bag 10 will have a high degree of symmetry.

The intermediate product manufactured as per the above process steps is then conveyed to a cut-out station for making the cut-outs 25 and then to the draw strip string insertion station 180 for insertion of a respective draw strip string 20' into the hems H1, H2 using conventional machinery, after which heat sealing/welding is performed along longitudinal line 6, to seal off the hems H1, H2 while still allowing the finalised bags 10 to be opened at the mouth, as shown in FIG. 3.

The folding illustrated in FIG. 5*b* corresponds to that shown in FIG. 5*a*. The principal difference is that the draw strip strings 20' may be positioned on one or both of the aforementioned second subparts 14, 14' before the fold lines C, C' are created, i.e. before the respective first parts 13, 13' in themselves are folded. Where only one of the draw strip strings 20' is positioned in this way the other draw strip string 20' may be positioned after creation of the hem, in the conventional manner.

The folding illustrated in FIG. 5*c* is for making hems H1, H2 by outward folding (away from each other) of two subparts 14, 14' along the side edges 7, 7', in a conventional manner using the hemmers of group G2, for making draw strip bags 10 as shown in FIG. 4*b*. It will be understood that the inserters required at insertion station 180 for performing process step 6) in FIG. 5*a* and process step 3) in FIG. 5*b* are different from the inserters used in process step 5*c*-4). In the first mentioned situation the inserters must reach into the gap G between the opposed first subparts 15, 15'. To accommodate for this, different sets of inserters may be connected to the draw strip string supply 200 of insertion station 180. In other words: using the apparatus 100 with a single string supply, including rollers G3 and all other machinery M required for suitable supply of the continuous string 20', but with one set of inserters replaced by another, will allow the apparatus 100 to selectively manufacture bags 10 of the type shown in FIG. 4*a* or the type shown in FIG. 4*b*. What is required is for the operator the run the web of film F to be processed either along the pathway through group G1 or through group G2 and position the correct inserter at insertion station 180. The is advantageous since apparatuses 100 for making draw strip bags 10 typically have ample space available on top of the insertion station 180 but less space available in the region of the insertion station whereby incorporating two different insertion stations 180, one for each type of bag 10 to be produced, is not practicable.

Wherein in the present text reference is made to entities having "essentially the same width"/"about the same width" or being "essentially aligned" or "near-aligned"/"in near alignment" with, a constant tolerance/deviation from "exact alignment" or "same width", intended or not, up to about 20 mm, such as in the order of 0.5 mm-20 mm, or more, such as in the order of 1 mm-13 mm or 1 mm-3 mm is contemplated. All deviations presented in claim 1 may apply together; alternatively only some of the defined deviations may apply. The web 1 typically has no geometrical variations lengthwise whereby any alignment/near alignment and width created in the folding is typically maintained along the entire length of the continuous web 1 of draw strip bags.

The apparatus claimed herein may alternatively have two groups G1, G2 of hemmers wherein the one group G1 is not for, or limited to performing the process disclosed above, but which may be configured to provide any folding different from the folding provided by the other group.

The invention claimed is:

1. A continuous method of making draw strip bags with two hems, comprising:

providing a film web wherein a first portion, comprising a first free longitudinal side edge, and a second portion, comprising a second free longitudinal side edge, overlap each other with the first free longitudinal side edge and the second free longitudinal side edge being aligned or near aligned with each other;

back folding a first part of the first portion, wherein the first part of the first portion comprises the first free longitudinal side edge, outwardly away from the second portion along a first fold line by a hemmer, with a remaining portion of the first portion, which does not include the first part of the first portion, remaining in full contact with the second portion;

folding a first subpart of the first part of the first portion along a second fold line, whereby the first free longitudinal side edge of the first portion is brought into near alignment, or alignment, with the first fold line while a second subpart of the first part of the first portion remains back folded, whereby the-first subpart of the first portion and the second subpart of the first portion define a first hem;

folding a first part of the second portion, wherein the first part of the second portion comprise the second free longitudinal side edge, to create a third fold line, with a first subpart of the first part of the second portion overlying a second subpart of the first part of the second portion and having an identical width, or about the identical width, such that the second longitudinal free edge of the second portion is aligned with, or nearly aligned with, the-first fold line of the first portion, whereby the first subpart of the second portion and the second subpart of the second portion define a second hem;

folding the first hem about the first fold line such that the second fold line is aligned with, or nearly aligned with, the third fold line of the second portion; and subsequent to the folding the first hem about the first fold line, inserting a draw strip string into the first hem and the second hem.

2. The method of claim 1, wherein a width of the first subpart of the first portion, a width of the second subpart of the first portion, the width of the first subpart of the second portion, and the width of the second subpart of the second portion are adjusted such that the first hem and the second hem are identical in size.

3. The method of claim 2, wherein the folding of the first part of the second portion is such that the first subpart of the second portion lies closer to the first portion than the second subpart of the second portion, so that the first subpart of the first portion and the first subpart of the second portion directly face each other.

4. The method of claim 3, wherein the folding of the first part of the second portion is carried out-simultaneously with the back-folding of the first part of the first portion.

5. The method of claim 2, wherein the folding of the first part of the second portion is such that the first subpart of the second portion lies farther away from the first portion than the second subpart of the second portion.

6. The method of claim 5, wherein the folding of the first part of the second portion is carried out-simultaneously with the back-folding of the first part of the first portion.

7. The method of claim 2, wherein after the folding of the first hem, the film web is conveyed to a station for making cut-outs, a station for inserting draw strip strings, and to perforation and welding stations.

8. The method of claim 1, wherein the folding of the first part of the second portion is such that the first subpart of the second portion lies closer to the first portion than the second subpart of the second portion, so that the first subpart of the first portion and the first subpart of the second portion directly face each other.

9. The method of claim 8, wherein after the folding of the first hem, the film web is conveyed to a station for making cut-outs, a station for inserting draw strip strings, and to perforation and welding stations.

10. The method of claim 8, wherein the folding of the first part of the second portion is carried out-simultaneously with the back-folding of the first part of the first portion.

11. The method of claim 1, wherein the folding of the first part of the second portion is such that the first subpart of the second portion lies farther away from the first portion than the second subpart of the second portion.

12. The method of claim 11, wherein after the folding of the first hem, the film web is conveyed to a station for making cut-outs, a station for inserting draw strip strings, and to perforation and welding stations.

13. The method of claim 11, wherein the folding of the first part of the second portion is carried out-simultaneously with the back-folding of the first part of the first portion.

14. The method of claim 1, wherein after the folding of the first hem, the film web is conveyed to a station for making cutouts, a station for inserting draw strip strings, and to perforation and welding stations.

* * * * *